US011103024B2

(12) United States Patent
Bischofberger et al.

(10) Patent No.: US 11,103,024 B2
(45) Date of Patent: Aug. 31, 2021

(54) HELMET WITH MAGNETICALLY-OPERATED AIR VENT

(71) Applicant: Bell Sports, Inc., Scotts Valley, CA (US)

(72) Inventors: Allen A. Bischofberger, Ben Lomond, CA (US); Scott S. Whitesell, Boulder Creek, CA (US); Scott R. Allen, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 495 days.

(21) Appl. No.: 16/017,664

(22) Filed: Jun. 25, 2018

(65) Prior Publication Data

US 2019/0387828 A1 Dec. 26, 2019

(51) Int. Cl.
*A42B 3/28* (2006.01)
*A42B 3/10* (2006.01)

(52) U.S. Cl.
CPC ..... *A42B 3/283* (2013.01); *A42B 3/10* (2013.01)

(58) Field of Classification Search
CPC .. A42B 3/286; A42B 3/28; A42B 3/10; A42B 3/0406; A42B 3/22; A42B 3/222; A42B 3/326; A42C 5/04; Y10S 2/01
USPC ..... 2/171.3
See application file for complete search history.

(56) References Cited

U.S. PATENT DOCUMENTS 3,496,854 A * 2/1970 Hill ..... A42B 3/28 454/370
3,860,966 A * 1/1975 Brown ..... A42B 3/32 2/415
4,744,106 A * 5/1988 Wang ..... A42B 3/286 2/171.3
5,592,936 A * 1/1997 Thomas, Jr. ..... A41D 13/11 128/201.24
2001/0032348 A1* 10/2001 Diaz ..... A41D 13/1153 2/171.3
2006/0213523 A1* 9/2006 VanDerWoude ..... A42B 3/286 128/863

(Continued)

FOREIGN PATENT DOCUMENTS

CA 2536844 * 8/2007 ..... A42B 3/28
CA 2536844 A1 8/2007

(Continued)

OTHER PUBLICATIONS

Decision to grant a European patent pursuant to Article 97(1) EPC, in related European patent application No. 19171236.3, dated Feb. 18, 2021.

*Primary Examiner* — Jillian K Pierorazio
(74) *Attorney, Agent, or Firm* — Walter M. Egbert, III; Gerard M. Donovan; Reed Smith LLP

(57) ABSTRACT

A helmet may include a helmet body and an air vent assembly. The air vent assembly may include a vent body including a vent border and a vent base; a vent cover pivotally coupled to the vent base by at least a cover anchor; and at least a first magnet disposed on at least one of the vent cover and the vent body, and at least a second magnet or attractor disposed on the other of the vent cover and the vent body opposite the at least a first magnet. The vent cover may pivot to the open position or the closed position through interaction between the at least a first magnet and the at least a second magnet or attractor.

9 Claims, 8 Drawing Sheets

(56) References Cited

U.S. PATENT DOCUMENTS

| | | | | |
|---|---|---|---|---|
| 2010/0095439 | A1* | 4/2010 | Nolan | A42B 3/24 2/421 |
| 2011/0154551 | A1* | 6/2011 | Spink | A42B 3/223 2/10 |
| 2012/0291227 | A1* | 11/2012 | Fiedler | F16B 1/0071 24/3.3 |
| 2013/0283508 | A1* | 10/2013 | Durham | A42B 3/221 2/422 |
| 2015/0082522 | A1* | 3/2015 | Rosati | A42B 3/22 2/424 |
| 2015/0296917 | A1* | 10/2015 | Perusse | A42B 3/286 2/15 |

FOREIGN PATENT DOCUMENTS

| | | |
|---|---|---|
| CN | 206213379 | 6/2017 |
| CN | 206213379 U | 6/2017 |

* cited by examiner

HELMET WITH MAGNETICALLY-OPERATED AIR VENT

TECHNICAL FIELD

Aspects of this document relate generally to helmets having air vents, and more specifically to a helmet comprising magnetically-operated air vents.

BACKGROUND

Protective headgear and helmets have wide uses. The wearer's head can get hot when the helmet is being worn. Air vents disposed through the helmet body of the helmet are used to cool the head. A wearer, however, may want to close the air vents at times when it rains, snows, or is too cold, or switch the vents between the open and closed positions to adjust the temperature of the head.

SUMMARY

According to an aspect, a helmet may comprise a helmet body including an outer shell and an energy management liner, a majority of the energy management liner disposed inside the outer shell, and an air vent assembly disposed on the outer shell, the air vent assembly comprising a vent body comprising a vent border and a vent base receded from the vent border and comprising at least one opening through the vent base, the vent base and the vent border forming a recess; a vent cover pivotally coupled to the vent base by at least a cover anchor, the vent cover configured to pivot between an open position and a closed position about a pivoting axis extending between the at least a cover anchor, and the vent cover covering at least a majority of the recess when the vent cover is in the closed position; and at least a first magnet disposed on the vent cover; and at least a second magnet or attractor disposed opposite the at least a first magnet on the vent body; wherein the vent cover is angled toward a side of the at least a second magnet or attractor through magnetic interaction between the at least a first magnet and the at least a second magnet or attractor when the vent cover is at the open position, and the vent cover is angled away from the side of the at least a second magnet or attractor through the magnetic interaction when the vent cover is at the closed position.

Particular embodiments may include one or more of the following features. The air vent assembly may comprise the attractor disposed on the vent base, the attractor coupling to the at least a first magnet at a second portion of the at least a first magnet and decoupled from a first portion of the at least a first magnet when the vent cover is in the closed position, and the attractor coupling to the at least a first magnet at a first portion of the at least a first magnet and decoupled from a second portion of the at least a first magnet when the vent cover is in the open position. The first portion and the second portion of the at least a first magnet may comprise separate magnets. The helmet may comprise two or more air vent assemblies each disposed in the outer shell. The air vent assembly may further comprise a gasket disposed between the vent border and the vent cover, the gasket comprising a first material, the vent cover comprising a second material, the first material softer than the second material. The air vent assembly may further comprise a gasket disposed between the vent border and the vent cover, the vent cover engaging with the gasket to resist water entry between the vent cover and the gasket when the vent cover is in the closed position. The air vent assembly may comprise the first magnet on the vent cover and the second magnet on the vent body adjacent the first magnet, the first magnet comprising a first polarity facing the second magnet, the second magnet comprising the first polarity facing the first magnet such that the first magnet and the second magnet repel each other, wherein the first magnet is angled toward a first side of the second magnet when the vent cover is in the open position, and wherein the first magnet is angled toward a second side of the second magnet when the vent cover is in the closed position.

According to an aspect, a helmet may comprise a helmet body including an outer shell and an energy management liner, a majority of the energy management liner disposed inside the outer shell, and an air vent assembly disposed in an outer surface of the outer shell, the air vent assembly comprising a vent body including a vent border and a vent base receded from the vent border, the vent base comprising at least one opening through the vent base, the vent base and the vent border forming a recess, a vent cover pivotally coupled to the vent base by at least a cover anchor, the vent cover configured to pivot between an open position and a closed position about a pivoting axis extending between the at least a cover anchor, the vent cover covering at least a majority of the recess when the vent cover is in the closed position, and at least a first magnet disposed on at least one of the vent cover and the vent body, and at least a second magnet or attractor disposed on the other of the vent cover and the vent body opposite the at least a first magnet, wherein the vent cover pivots to the open position through interaction between the at least a first magnet and the at least a second magnet or attractor when first pressure is exerted upon a first portion of the vent cover, and the vent cover pivots to the closed position through the interaction between the at least a first magnet and the at least a second magnet or attractor when second pressure is exerted upon a second portion of the vent cover opposite the first portion.

Particular embodiments may comprise one or more of the following features. The at least a first magnet may further comprise a first portion and a second portion, wherein the first portion is magnetically coupled to the at least a second magnet or attractor when the vent cover is in the open position and the first portion is decoupled from the at least a second magnet or attractor when the vent cover is in the closed position, and wherein the second portion is magnetically coupled to the at least a second magnet or attractor when the vent cover is in the closed position and the second portion is decoupled from the at least a second magnet or attractor when the vent cover is in the open position. The first portion and the second portion of the at least a first magnet may comprise separate magnets. The helmet may comprise two or more air vent assemblies each disposed in the outer shell. The air vent assembly may further comprise a gasket disposed between the vent border and the vent cover, the gasket comprising a first material, the vent cover comprising a second material, the first material softer than the second material. The air vent assembly may further comprise a gasket disposed between the vent border and the vent cover, an edge of the vent cover engaging with the gasket to resist water entry between the vent cover and the gasket when the vent cover is in the closed position. The air vent assembly may comprise the first magnet on the vent cover and the second magnet on the vent body adjacent the first magnet, the first magnet comprising a first polarity facing the second magnet, the second magnet comprising the first polarity facing the first magnet such that the first magnet and the second magnet repel each other, wherein the first magnet is angled toward a first side of the second magnet when the vent cover is in the open position, and wherein the first magnet is angled toward a second side of the second magnet when the vent cover is in the closed position.

According to an aspect, an air vent assembly for a helmet may comprise a vent body including a vent border and a vent base receded from the vent border, the vent base comprising at least one opening through the vent base, the vent base and the vent border forming a recess; a vent cover pivotally coupled to the vent base by at least a cover anchor, the vent cover configured to pivot between an open position and a closed position about a pivoting axis extending between the at least a cover anchor, the vent cover covering at least a majority of the recess when the vent cover is in the closed position, and at least a first magnet disposed on at least one of the vent cover and the vent body, and at least a second magnet or attractor disposed on the other of the vent cover and the vent body opposite the at least a first magnet; wherein the vent cover pivots to the open position through interaction between the at least a first magnet and the at least a second magnet or attractor when first pressure is exerted upon a first portion of the vent cover, and the vent cover pivots to the closed position through the interaction between the at least a first magnet and the at least a second magnet or attractor when pressure is exerted upon a second portion of the vent cover opposite the first portion.

Particular embodiments may comprise one or more of the following features. The at least a first magnet may further comprise a first portion and a second portion, wherein the first portion is magnetically coupled to the at least a second magnet or attractor when the vent cover is in the open position and the first portion is decoupled from the at least a second magnet or attractor when the vent cover is in the closed position, and wherein the second portion is magnetically coupled to the at least a second magnet or attractor when the vent cover is in the closed position and the second portion is decoupled from the at least a second magnet or attractor when the vent cover is in the open position. The air vent assembly may further comprise a gasket disposed between the vent border and the vent cover, the gasket comprising a first material, the vent cover comprising a second material, the first material softer than the second material. The air vent assembly may further comprise a gasket disposed between the vent border and the vent cover, an edge of the vent cover engaging with the gasket to resist water entry between the vent cover and the gasket when the vent cover is in the closed position. The air vent assembly may comprise the first magnet on the vent cover and the second magnet on the vent body adjacent the first magnet, the first magnet comprising a first polarity facing the second magnet, the second magnet comprising the first polarity facing the first magnet such that the first magnet and the second magnet repel each other, wherein the first magnet is angled toward a first side of the second magnet when the vent cover is in the open position, and wherein the first magnet is angled toward a second side of the second magnet opposite the first side of the second magnet when the vent cover is in the closed position.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
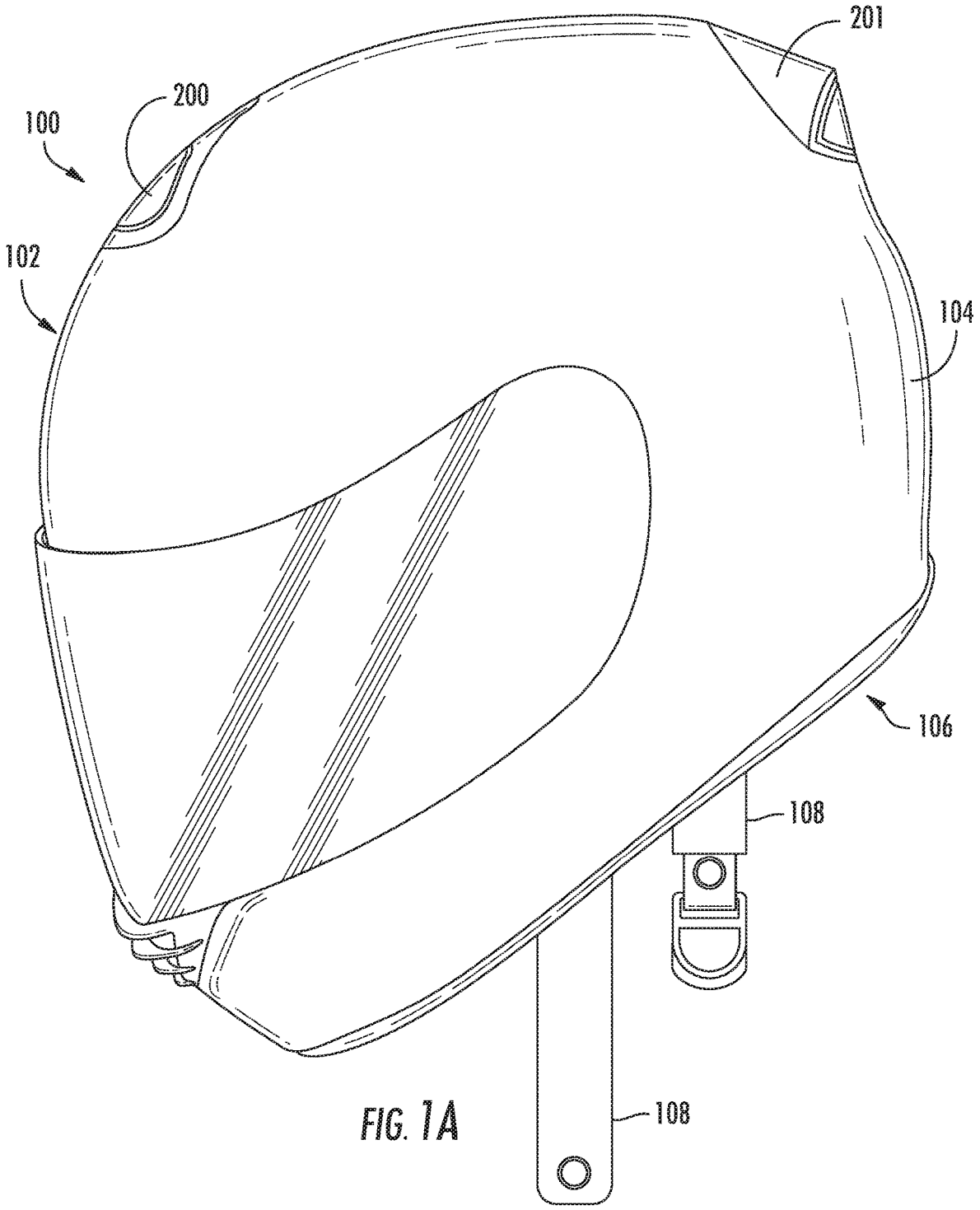
FIG. 1A is a side view of a helmet with air vent assemblies, where the air vent assemblies are closed.

While this disclosure includes embodiments in many different forms, they are shown in the drawings and will herein be described in detailed particular embodiments with the understanding that the present disclosure is to be considered as an exemplification of the principles of the disclosed methods and systems, and is not intended to limit the broad aspect of the disclosed concepts to the embodiments illustrated.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a user to releasably wear the helmet, and to ensure the helmet remains on the user's head during an impact.

Protective headgear or helmets can be used for a snow skier, cyclist, football player, hockey player, baseball player, lacrosse player, polo player, climber, auto racer, motorcycle rider, motocross racer, snowboarder or other snow or water athlete, sky diver, or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. allowing ventilation and variation of sizes). Some helmets are made of two or more bodies of energy-absorbing material formed in shapes that would be difficult, if not impossible, to achieve in a single molded piece.

Various implementations and embodiments of protective helmets according to this disclosure comprise a protective shell. The protective shell may be formed of an energy absorbing material such as expanded polystyrene (EPS), expanded polyurethane (EPU), expanded polyolefin (EPO), expanded polypropylene (EPP), or other suitable material. The energy absorbing material can be used as part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material may comprise one or more layers of EPP and provide more flexibility. Alternatively, the energy absorbing material may be part of an in-molded helmet such as a bicycle helmet. An outer shell, such as a layer of stamped polyethylene terephthalate or a polycarbonate shell, may be included on an outer surface of the protective shell of the helmet and be bonded directly to the energy management liner.

Air vents installed on the helmet are used for ventilation to a wearer's head. Conventional air vents are switched between the open and closed positions using detents and through the friction between the detents and the vent cover. Using such mechanism, the vent cover may wobble. Wobbly vent covers are less secure and make more noise when faced with a headwind than secure vent covers. Further, after a certain period of time, the detents may be worn out, causing the vent cover to fail to remain open or closed when placed in a desired position.

Figure 1B:
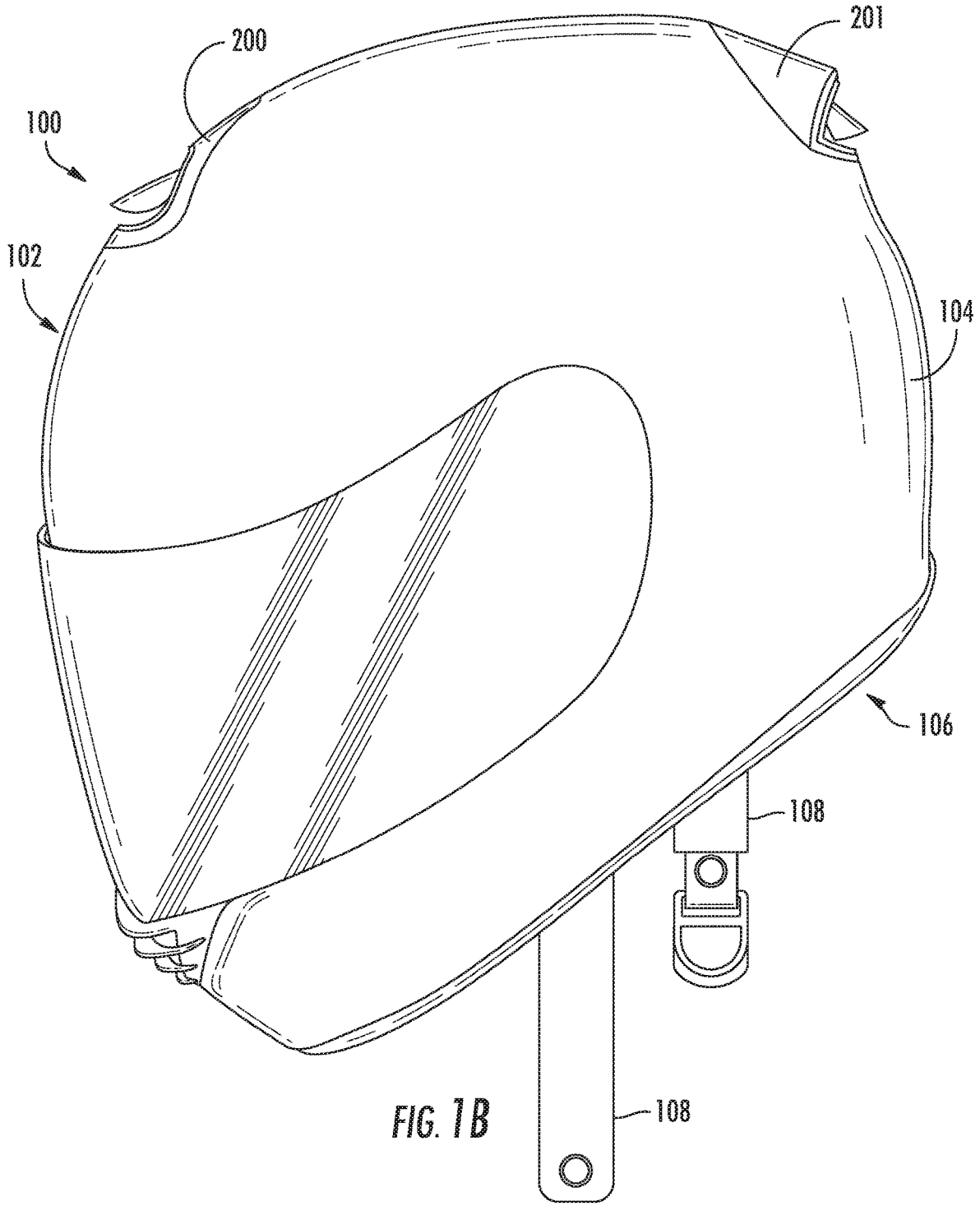
FIG. 1B is a side view of the helmet shown in FIG. 1A with the air vent assemblies open.

Contemplated as part of this disclosure is a helmet having magnetically-secured air vents. FIGS. 1A-1B illustrate an example helmet 100 installed with one or more air vent assemblies 200, 201, where the air vent assembly 200 is at the top of the helmet 100 and/or the air vent assembly 201 is at the rear of the helmet 100. An air vent assembly 200, 201 may be installed at locations on the helmet other than at the top or the rear of the helmet, such as the front or the sides. FIG. 1A shows air vent assemblies 200, 201 in a closed position. FIG. 1B shows air vent assemblies 200, 201 in an open position. Other number of air vent assemblies may be installed on the helmet, such as one, three or more.

A helmet 100 comprises a helmet body 102 (FIGS. 1A and 1B). The helmet body 102 may comprise an outer shell 104 and an energy management liner 106. Where an outer shell 104 is used, the majority of the energy management liner 106 is disposed within the outer shell 104. A helmet 100 may further comprise a fit system 108 to fit the helmet 100 onto a wearer's head.

Figure 2A:
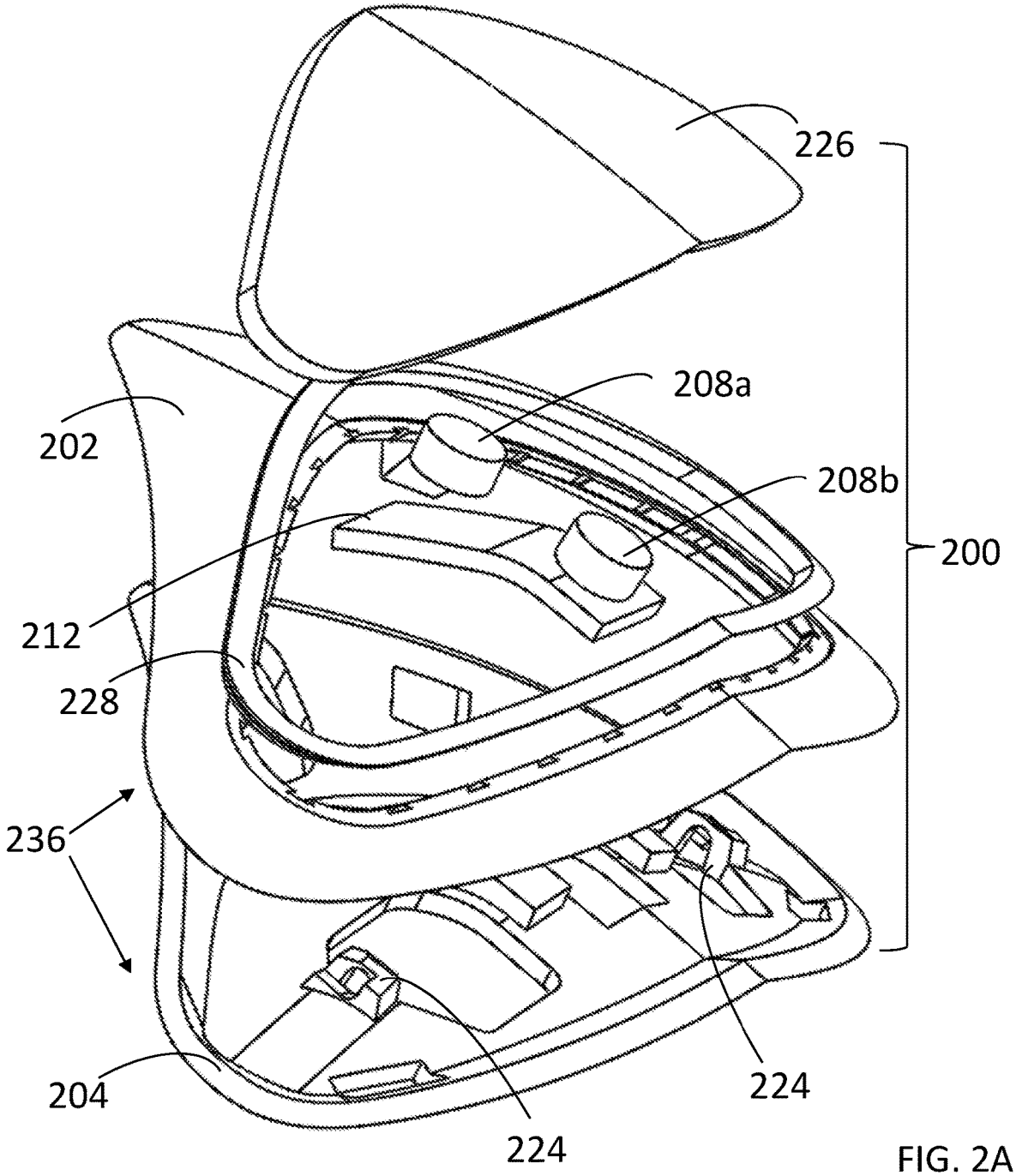
FIG. 2A is an exploded view of an example air vent assembly.
Figure 2B:
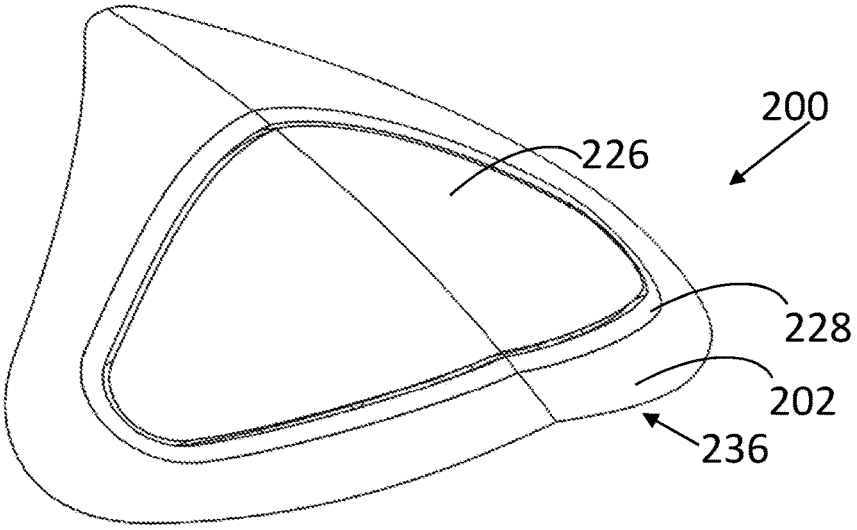
FIG. 2B is a top view of the air vent assembly shown in FIG. 2A.
Figure 2C:
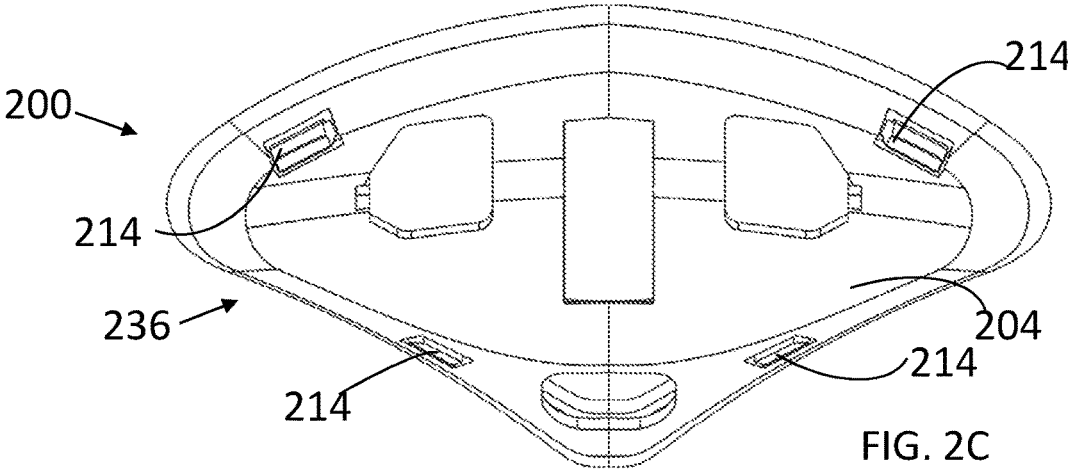
FIG. 2C is the bottom view of the air vent assembly shown in FIG. 2A.
Figure 2D:
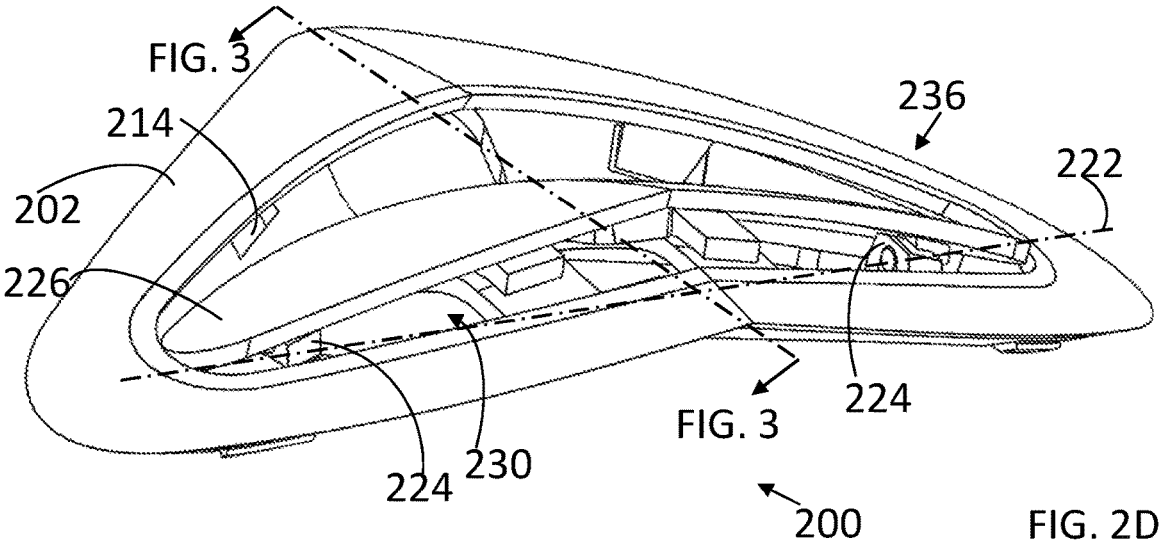
FIG. 2D is the top view of the air vent assembly shown in FIG. 2A when the air vent assembly is in the open position.

FIGS. 2A-2D show an example air vent assembly 200. FIG. 2A is an exploded view of an air vent assembly 200. FIG. 2B is a top view of the air vent assembly 200 when the air vent assembly 200 is in the closed position. FIG. 2B shows a bottom view of the air vent assembly 200. FIG. 2D shows the top view of the air vent assembly 200 when the air vent assembly 200 is in the open position. FIGS. 5A-7B show another example of an air vent assembly 201.

An air vent assembly 200, 201 comprises a vent cover 226, 227 and a vent body 236, 237 (FIGS. 2A-3 and 5A-6B). The vent body 236, 237 further comprises a vent border 202, 203 and a vent base 204, 205. The vent border 202, 203 borders the vent base 204, 205 and the vent base 204, 205 recedes from the vent border 202, 203 and forms a recess 230, 231 with the vent border 202, 203. The vent base 204 comprise an opening 214 for air to pass through (FIG. 2C) it. The vent cover, vent border, and vent base may be made of the same material or made of their own separate material. By example, they may be made of plastic, rubber, metal, or other suitable material.

Figure 5A:
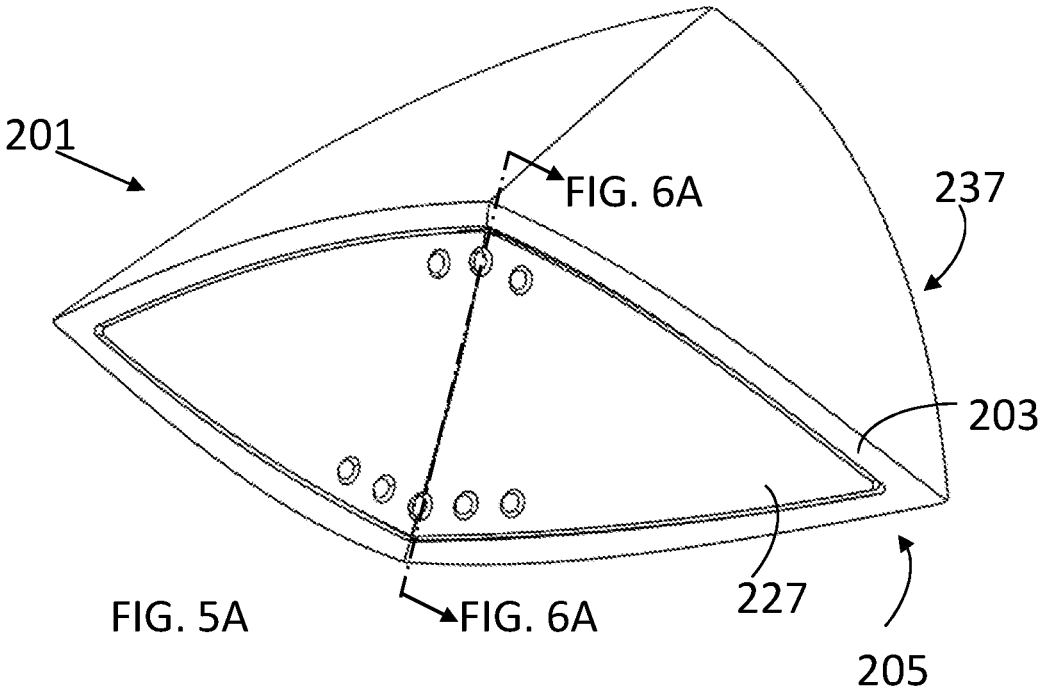
FIG. 5A shows another example air vent assembly, where the air vent assembly is in the closed position.
Figure 5B:
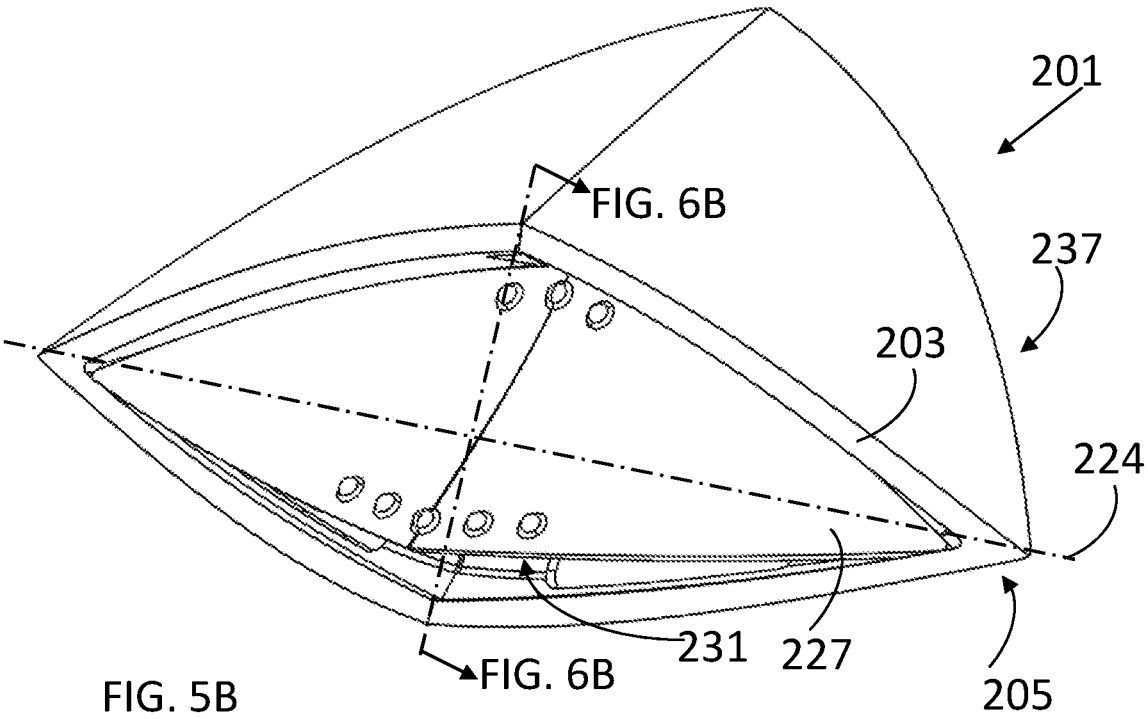
FIG. 5B shows the air vent assembly shown in FIG. 5A with the air vent assembly in the open position.
Figure 6A:
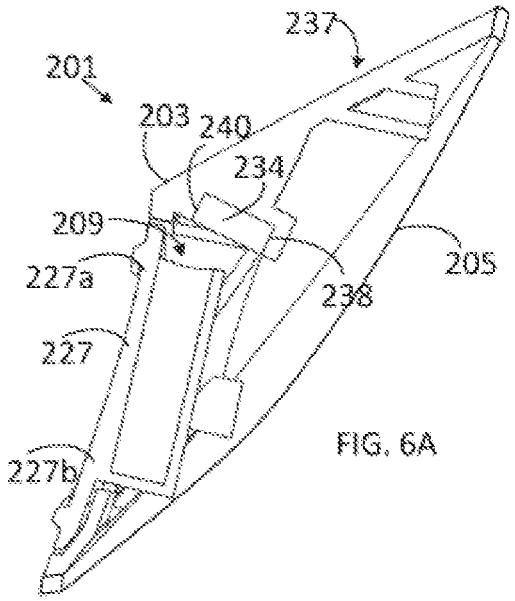
FIG. 6A shows a cross-sectional view of the air vent assembly shown in FIG. 5A, taken along cross-section lines 6A-6A.

The vent cover 226, 227 of the air vent assembly 200, 201 is pivotally coupled to the vent base 204, 205 through one or more cover anchors 224. The cover anchor 224 is positioned at the side of the vent cover 226 (FIGS. 2A and 2D) or at the mid-section of the vent cover. A pivoting axis 222 extends through the cover anchors 224 or between the cover anchors 224 (FIG. 2D). The vent cover 226, 227 pivots about the pivoting axis 222 between an open position (shown in FIGS. 2D, 5B) and a closed position (shown in FIGS. 2B, 5A). When the air vent assembly 200, 201 is at the closed position, the vent cover 226, 227 covers a majority of the recess 230, 231 (FIGS. 2B, 5A). When the air vent assembly 200, 201 is in an open position, the vent cover 226, 227 opens and allows air to go in and through openings 214 (FIGS. 2D, 5B (opening 214 not shown in FIG. 5B)).

The air vent assembly 200, 201 further comprises at least a first magnet 208, 209 and at least a second magnet 234 or attractor 212. (FIGS. 2A, 3, 5A-7B). The first magnet 208, 209 is disposed opposite the second magnet 234 or the attractor 212. The vent cover 226, 227 pivots between an open position and a closed position through the interaction between the first magnet 208, 209 and the second magnet 234 or attractor 212. In some embodiments, the first magnet 208, 209 and the attractor 212 attract and couple to each other. In some embodiments, the first magnet 208, 209 and the second magnet 234 repel each other. To open the air vent assembly and allow air into the helmet body, first pressure is applied to the first portion of the vent cover 226*a*, 227*a*. To close the air vent assembly to restrict air from going into the vent and through the helmet body, second pressure may be applied to the second portion 226*b*, 227*b* of the vent cover. The thickness of the first magnet 208, 209, the attractor 212, and the second magnet 234 may be varied to adjust the strength of the interaction between the first magnet 208, 209 and the second magnet 234 or the attractor 212, and tune the function of opening and closing the air vent assembly 200, 201.

Figure 3:
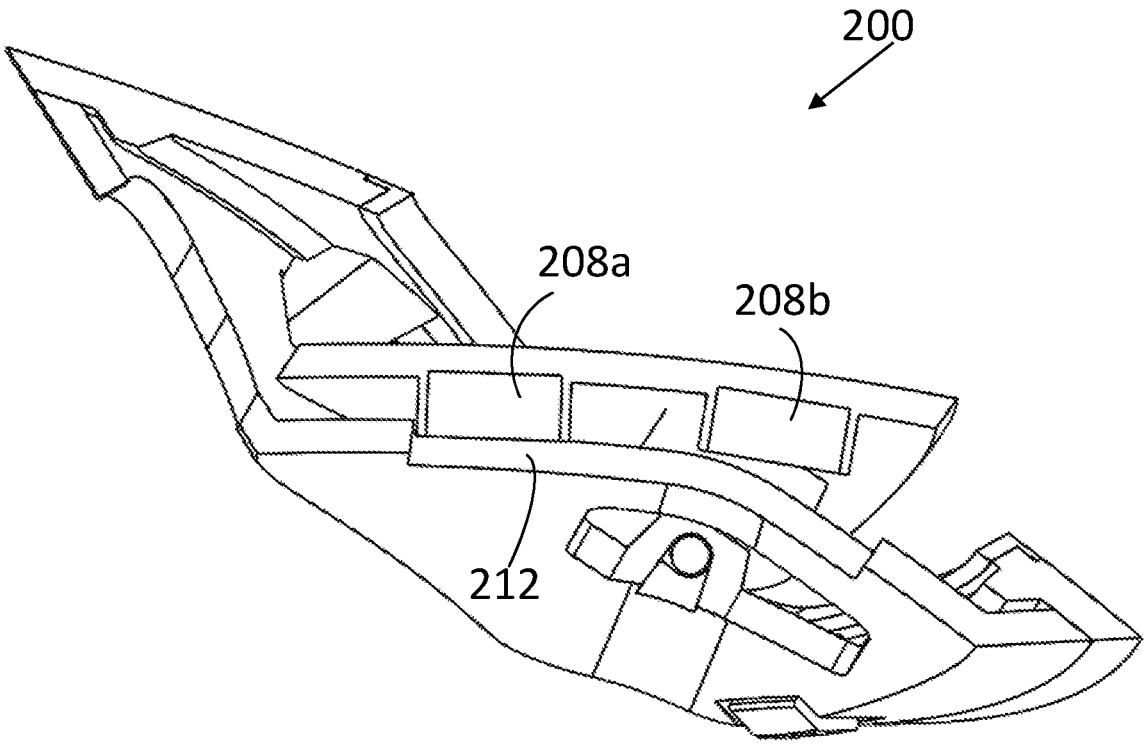
FIG. 3 is a cross-sectional view of the air vent assembly shown in FIG. 2D, taken along cross-section lines 3-3.

In some embodiments, the air vent assembly 200 comprises at least a first magnet 208 and at least an attractor 212 (FIGS. 2A and 3). FIG. 3 shows a cross-sectional view of the air vent assembly 200. An attractor used herein may be a magnet having the same or an opposite polarity to the first magnet or be a piece of metal attracted to the first magnet. The first magnet 208 may be disposed on the vent cover 226 or on the vent base 204. The attractor 212 may be disposed on the vent base 204 or on the vent cover 226 opposite the first magnet 208. In some embodiments, if a first magnet 208 is disposed on the vent cover 226, a corresponding attractor 212 is disposed on the opposite position on vent base 204, or if a first magnet 208 is disposed on the vent base 204, a corresponding attractor 212 is disposed on the opposite position on vent cover 226, so that the first magnet 208 and its corresponding attractor 212 attract to each other and facilitate the opening and closing of the vent cover 226.

The first magnet 208 comprises a first portion 208*a* and a second portion 208*b*. In some embodiments, the air vent assembly comprises one first magnet. In some embodiments, the air vent assembly 200 comprises more than one magnet, such as two separate magnets 208*a*, 208*b* (FIGS. 2A and 3). The magnet 208*a*, 208*b* may be disposed at separate locations (FIGS. 2A and 3). In some embodiments, the air vent assembly comprises more than one attractors.

In some embodiments, after the exertion of the first pressure, the vent cover 226 is at an open position, and the first portion of the magnet 208*a* is coupled with the attractor 212*b* and the second portion of the first magnet 208*b* is decoupled from the attractor 212 (FIG. 3). In some embodiments, after the exertion of the second pressure, the vent cover 226 is at the closed position, and the second portion of the first magnet 208*b* is coupled with the attractor 212*a* and the first portion of the first magnet 208*a* is decoupled from the attractor 212.

Figure 4A:
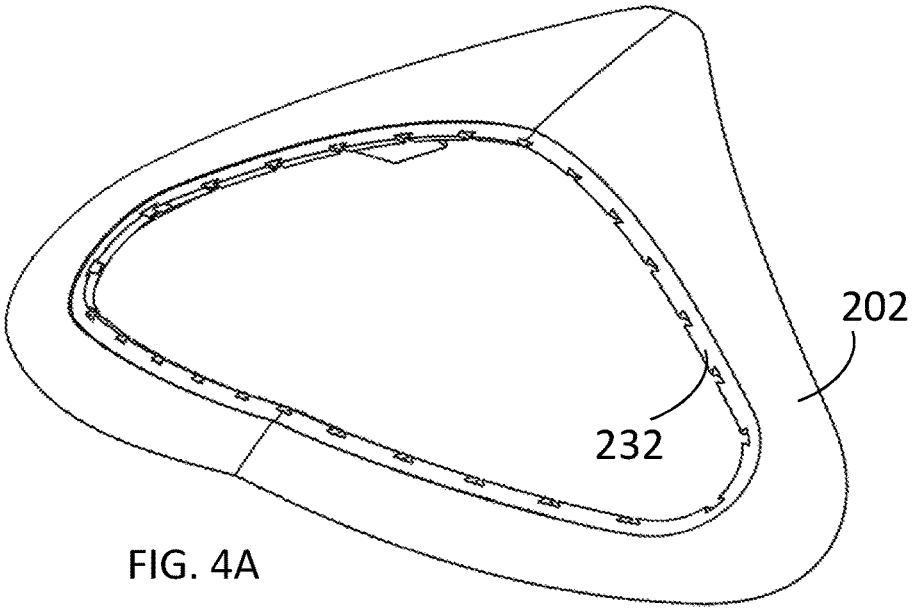
FIG. 4A shows a vent border of an air vent assembly.
Figure 4B:
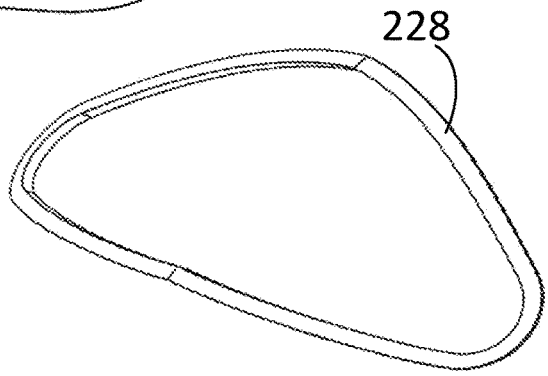
FIG. 4B shows a gasket.
Figure 4C:
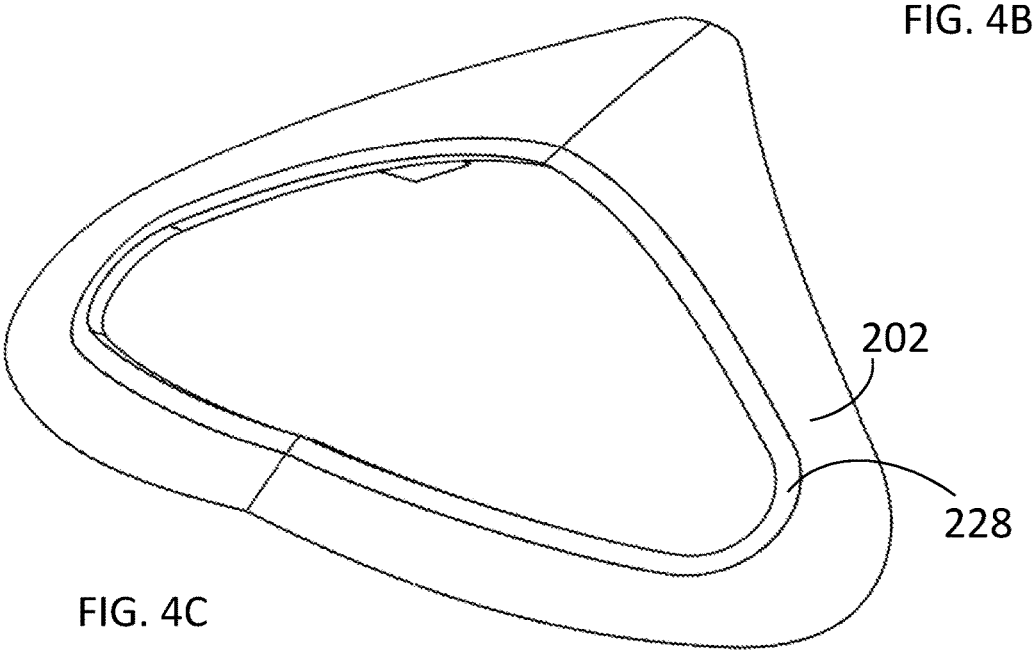
FIG. 4C shows the gasket shown in FIG. 4B placed on the vent border shown in FIG. 4A.

The air vent assembly 200 may further comprise a gasket 228 disposed between the vent cover 226 and the vent border 202 (FIGS. 2B and 4B-4C). The gasket 228 may be disposed around the edge of the vent cover 226 or may line the edge 232 of the vent border 202 (FIG. 4C). The gasket 228 will generally be formed with a material softer than the material that the vent cover 226 or the vent border 202 is formed with. The gasket 228 may be engaged with the edge 232 of the vent cover 226 and may be configured to resist water from entering into the vent when the vent cover 226 is in a closed position to restrict water or snow from going into the helmet 100 during a raining or snowing condition (see FIG. 2B).

Figure 7A:
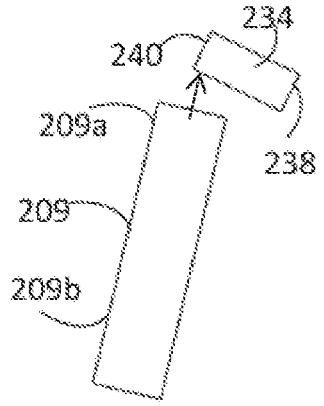
FIG. 7A shows the first magnet and the second magnet of the air vent assembly shown in FIG. 6A separate from most of the air vent assembly in the open position for clarity.
Figure 6B:
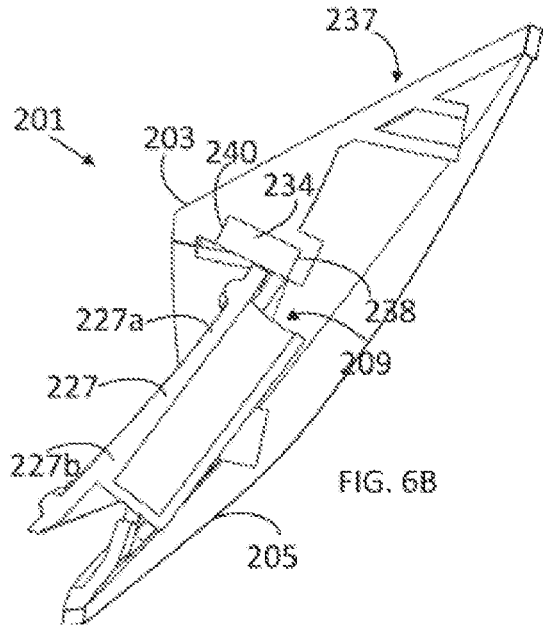
FIG. 6B shows a cross-sectional view of the air vent assembly shown in FIG. 5B, taken along cross-section lines 6B-6B.
Figure 7B:
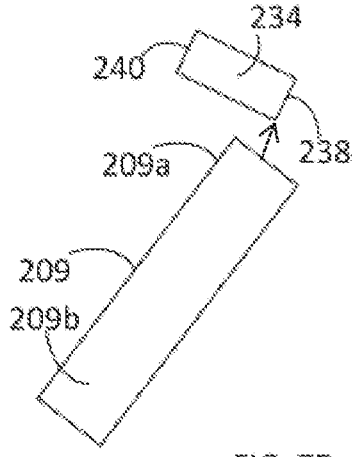
FIG. 7B shows the first magnet and the second magnet of the air vent assembly shown in FIG. 6B separate from most of the air vent in the closed position for clarity.

FIGS. 5A-7B show another example of an air vent assembly 201. FIG. 5A shows the air vent assembly 201 in a closed position. FIG. 5B shows the air vent assembly 201 at an open position. The air vent assembly 201 may comprise a first magnet 209 and a second magnet 234 (FIGS. 6A-7B). FIGS. 6A and 6B respectively show the cross-sectional view of the air vent assembly 201 when the air vent assembly 201 is at the closed position (FIG. 6A) or at the open position (FIG. 6B). FIGS. 7A and 7B respectively show the relative positions of the first magnet 209 and the second magnet 234 when the air vent assembly 201 is at the closed position (FIG. 7A) or at the open position (FIG. 7B) when the remaining parts of the air vent assembly 201 are deleted to show only first magnet 209 and second magnet 234. These figures show that first magnet 209 and second magnet are spaced apart and are not touching each other in the air vent assembly 201. First magnet 209 and second magnet 234 relate to each other due to magnetic forces between them. In FIG. 7A, first end 209*a* of first magnet 209 is oriented or angled toward end 240 of magnet 234, as indicated by the dashed arrow, when the air vent assembly 201 is in the closed position. In FIG. 7B, first end 209*a* of first magnet 209 is oriented or angled toward end 238 of magnet 234, as indicated by the dashed arrow, when the air vent assembly 201 is in the open position.

The air vent assembly 201 may comprise a first magnet 209 and a second magnet 234. The second magnet 234 may be disposed in the vent body 237. The second magnet 234 may be disposed between the vent border 203 and the vent base 205. The second magnet 234 comprises a first side 238 and a second side 240 opposite the first side. In some embodiments, the first side 238 of the second magnet is disposed proximate to the vent base 205 with the second side 240 proximate the vent border 203. In some embodiments, the second magnet 234 is disposed proximate a first portion of the first magnet 209*a*. The portions of the first magnet 209 and the second magnet 234 that face each other may have the same polarity.

To close the air vent assembly 201, second pressure is applied to the second portion of the vent cover 227*b*. Because of the same polarity, the second magnet 234 pushes the first magnet 209 away from itself and the vent base 205, and the first magnet 209 is angled away from the first side 238 of the second magnet 234 but toward the second side 240 of the second magnet 234 (FIG. 7A). To open the air vent assembly 201, first pressure is applied to the first portion of the vent cover 227*a*. Also because of the same polarity, the second magnet 234 pushes the first magnet 209 away from itself and toward the vent base 205 and, as a result, the first magnet 209 is angled toward the first side 238 of the second magnet 234 and away from the second side 240 of the second magnet 234 (FIG. 7B). For air vent assemblies 201, during the opening and closing of the air vent assembly, the first magnet 209 and the second magnet 234 do not touch each other and, therefore, sound produced during the interaction or wear-and-tear of the parts may be reduced.

The air vent assemblies 200, 201 or parts of the air vent assemblies 200, 201 may be in-molded with other air vent parts and components. In some embodiments, the attractor or magnet 212 may be in-molded into the vent base 204 so that a portion of the vent base 204 is formed around the attractor or magnet.

The air vent assemblies disclosed herein use the magnetic force to facilitate the opening and closing of the vent cover and keep the vent cover in the open or closed position. Compared to conventional vents that use friction to facilitate holding the vent cover in the open and closed position, the opening and closing of the vent cover of the air vent assemblies disclosed herein is smooth, and wear-to-tear to the parts is largely reduced. Further, because of the magnetic force, the vent cover may at the open or closed position and has much less or no noticeable wobble. Consequently, noise from wobbling vent cover during the high-speed riding may be reduced, or even avoided.

This disclosure, its aspects and implementations, are not limited to the specific components or assembly procedures disclosed herein. Many additional components and assembly procedures known in the art consistent with the intended helmets and methods of assembling a helmet will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets and methods of assembling a helmet are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet and methods of assembling a helmet may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

The invention claimed is:

1. A helmet comprising:

a helmet body including:

an outer shell; and an energy management liner, a majority of the energy management liner disposed inside the outer shell; and an air vent assembly disposed on the outer shell, the air vent assembly comprising:

a vent body comprising a vent border and a vent base receded from the vent border and comprising at least one opening through the vent base, the vent base and the vent border forming a recess;

a vent cover pivotally coupled to the vent base by at least a cover anchor, the vent cover configured to pivot between an open position and a closed position about a pivoting axis extending between the at least a cover anchor, and the vent cover covering at least a majority of the recess when the vent cover is in the closed position; and at least a first magnet disposed on the vent cover; and at least a second magnet disposed opposite the at least a first magnet on the vent body, wherein the at least a first magnet comprises a first polarity facing the at least a second magnet, the second at least a magnet comprises the first polarity facing the at least a first magnet such that the at least a first magnet and the at least a second magnet repel each other;

wherein the at least a first magnet is angled toward a first side of the at least a second magnet and the vent cover is angled toward a first side of the at least a second magnet through magnetic interaction between the at least a first magnet and the at least a second magnet when the vent cover is at the open position, and the at least a first magnet is angled toward a second side of the at least a second magnet and the vent cover is angled away from the second side of the at least a second magnet through the magnetic interaction when the vent cover is at the closed position.

2. The helmet of claim 1, the at least a first magnet further comprising a first portion and a second portion wherein the first portion and the second portion of the at least a first magnet comprise separate magnets, wherein the first portion is magnetically coupled to the at least a second magnet when the vent cover is in the open position and the first portion is decoupled from the at least a second magnet when the vent cover is in the closed position, and wherein the second portion is magnetically coupled to the at least a second magnet when the vent cover is in the closed position and the second portion is decoupled from the at least a second magnet when the vent cover is in the open position.

3. The helmet of claim 1, wherein the helmet comprises two or more air vent assemblies each disposed in the outer shell.

4. The helmet of claim 1, wherein the at least a first magnet and the at least a second magnet are spaced apart and are not touching each other.

5. A helmet comprising:

a helmet body including an outer shell and an energy management liner, a majority of the energy management liner disposed inside the outer shell; and an air vent assembly disposed in an outer surface of the outer shell, the air vent assembly comprising:

a vent body including a vent border and a vent base receded from the vent border, the vent base comprising at least one opening through the vent base, the vent base and the vent border forming a recess;

a vent cover pivotally coupled to the vent base by at least a cover anchor, the vent cover configured to pivot between an open position and a closed position about a pivoting axis extending between the at least a cover anchor, the vent cover covering at least a majority of the recess when the vent cover is in the closed position; and at least a first magnet disposed on the vent cover, and at least a second magnet disposed on the vent body adjacent to and opposite the at least a first magnet; wherein the at least a first magnet comprises a first polarity facing the at least a second magnet, the second magnet comprising the first polarity facing the at least a first magnet such that the at least a first magnet and the at least a second magnet repel each other;

wherein the at least a first magnet is angled toward a first side of the at least a second magnet and the vent cover pivots to the open position through interaction between the at least a first magnet and the at least a second magnet when first pressure is exerted upon a first portion of the vent cover, and the at least a first magnet is angled toward a second side of the at least a second magnet and the vent cover pivots to the closed position through the interaction between the at least a first magnet and the at least a second magnet when second pressure is exerted upon a second portion of the vent cover opposite the first portion.

6. The helmet of claim 5, wherein the helmet comprises two or more air vent assemblies each disposed in the outer shell.

7. The helmet of claim 5, wherein the at least a first magnet and the at least a second magnet are spaced apart and are not touching each other.

8. An air vent assembly for a helmet, the air vent assembly comprising:

a vent body including a vent border and a vent base receded from the vent border, the vent base comprising at least one opening through the vent base, the vent base and the vent border forming a recess;

a vent cover pivotally coupled to the vent base by at least a cover anchor, the vent cover configured to pivot between an open position and a closed position about a pivoting axis extending between the at least a cover anchor, the vent cover covering at least a majority of the recess when the vent cover is in the closed position; and at least a first magnet disposed on the vent cover, and at least a second magnet disposed on the vent body opposite the at least a first magnet, wherein the at least a first magnet comprises a first polarity facing the second magnet, the second magnet comprising the first polarity facing the first magnet such that the first magnet and the second magnet repel each other;

wherein first magnet is angled toward a first side of the second magnet the vent cover pivots to the open position through interaction between the at least a first magnet and the at least a second magnet when first pressure is exerted upon a first portion of the vent cover, and the vent cover pivots to the closed position through the interaction between the at least a first magnet and the at least a second magnet when pressure is exerted upon a second portion of the vent cover opposite the first portion;

wherein the first magnet is angled toward a first side of the second magnet when the vent cover is in the open position, and wherein the first magnet is angled toward a second side of the second magnet opposite the first side of the second magnet when the vent cover is in the closed position.

9. The air vent assembly of claim 8, wherein the at least a first magnet and the at least a second magnet are spaced apart and are not touching each other.

* * * * *